United States Patent [19]

Grigorenko

[11] Patent Number: 4,801,038

[45] Date of Patent: Jan. 31, 1989

[54] CAN TOP OPENING ASSEMBLY AND METHOD OF MAKING SAME

[76] Inventor: Donald C. Grigorenko, 8625 Dunblane Ct., Dublin, Ohio 43017

[21] Appl. No.: 158,479

[22] Filed: Feb. 22, 1988

[51] Int. Cl.[4] ..... B65D 17/34

[52] U.S. Cl. ..... 220/269; 413/16

[58] Field of Search ..... 220/269, 273; 413/12, 413/14, 15, 16

[56] References Cited

U.S. PATENT DOCUMENTS

| | | | |
|---|---|---|---|
| 2,261,117 | 11/1941 | Jack, Jr. | 220/269 |
| 4,051,976 | 10/1977 | Perry | 220/269 |
| 4,576,305 | 3/1986 | Saunders | 220/269 |
| 4,624,386 | 11/1986 | Grigorenko et al. | 220/269 |

*Primary Examiner*—George T. Hall

*Attorney, Agent, or Firm*—Porter, Wright, Morris & Arthur

[57] ABSTRACT

An integral tongue is lanced from a steel can top except along a transverse bend line scored on the undersurface of the tongue adjacent to the can top. An arcuate nose portion of a pull tab is riveted to a first portion of the tongue. Opposing shoulders on the tab overlie portions of the can top adjacent to the tongue. A ring or lever portion of the tab is lifted and pivoted on the shoulders, thereby bending the first portion of the tongue under a ribbed second portion. The pull tab is then pivoted in the opposite direction, thereby displacing the entire tongue outwardly relative to the can top along the bend line.

14 Claims, 2 Drawing Sheets

CAN TOP OPENING ASSEMBLY AND METHOD OF MAKING SAME

TECHNICAL FIELD

This invention relates generally to metal can tops having built-in, manually operable opening means, and more particularly to an opening assembly which includes an integral tongue arranged normally to occupy a closed position relative to the can top and a pull tab for displacing the tongue relative to said closed position.

BACKGROUND ART

The closest prior art known to the inventor is disclosed in U.S. Pat. No. 4,624,386 issued Nov. 25, 1986 to the present inventor and another, and the references cited therein. Said patent discloses a tongue lanced from the can top except along a single transverse bend line and having a marginal edge disposed beneath an edge of the can top defining an opening therein, thereby preventing accidental displacement of the tongue upwardly through the opening in the can top. A thin film of synthetic resin material is adhesively secured to the underside of the can top in underlying relation to the tongue, so as to seal the opening shut until the tongue is intentionally bent upwardly through the opening by means of a ring tab to break the seal and provide access to the contents of the can.

One of the primary advantages of this earlier easy opening can top was the movement of the tongue upwardly and outwardly from the opening, thereby preventing contact between the tongue and the contents of the can. One of the disadvantages of this invention, however, was the need to apply additional force to lift the tongue over the overlapping edge of the opening, as compared to the relatively slighter force required to push the tongue downwardly through the opening, as accomplished with most conventional can top opening assemblies. U.S. Pat. No. 4,051,976 issued Oct. 4, 1977 to Perry discloses such a conventional opening assembly.

Thus, the present inventor was faced with the problems of devising a can top opening assembly which was economical and durable, that required no additional or auxiliary opening devices, that required less effort to open than previous models, and that prevented the tongue from having sustained contact, upon opening, with the beverage or other contents of the can.

DISCLOSURE OF THE INVENTION

The present can top opening assembly comprises a tongue integrally formed in the can top and provided with a tab-engaging component and a pull tab provided with a tongue-engaging component overlying the tongue, a pivot component projecting from the pull tab in overlying relation to at least one point on the can top adjacent to the tongue, and a lever component. The lever component is manually movable in a first direction to displace a first portion of the tongue under a second portion thereof and is manually movable in a second direction to displace the tongue outwardly relative to the can top.

In addition, the present invention encompasses a method of forming a can top opening assembly which basically comprises forming a tongue on the can top, providing the tongue with a tab-engaging component, providing a pull tab with a tongue-engaging component, a pivot component and a lever component and securing the pull tab to the tongue. Further, the pull tab is secured to the tongue in such a manner that the tongue-engaging component is disposed in overlying relation to the tongue, the pivot component projects from the tab in overlying relation to at least one point on the can top adjacent to the tongue, and the lever component is manually movable in one direction to displace a first portion of the tongue under a second portion thereof and is manually movable in a second direction to displace the tongue outwardly relative to the can top. Preferably, the can top and integral tongue are formed from steel, the tongue is lanced from the can top except along one end thereof, and a leading edge segment of the first portion of the tongue is normally disposed in underlying relation to an adjacent area of the can top. In addition, it is advantageous to apply a film of rupturable synthetic resin material to an underside of the can top in covering relation to the tongue.

A primary object of the present invention is to provide a can top and an attractive opening assembly therefor which are fashioned from steel. Another object of the present invention is to provide a can top opening assembly which requires a minimal amount of energy to open and which provides a durable and effective seal in its normally closed position. Yet another object is to provide an integral tongue which does not contact the contents of the can once it is fully opened. Further objects and advantages of the present invention may be more readily understood in light of the following drawings and description of the preferred embodiment.

BEST MODE FOR CARRYING OUT THE INVENTION

Figure 1:
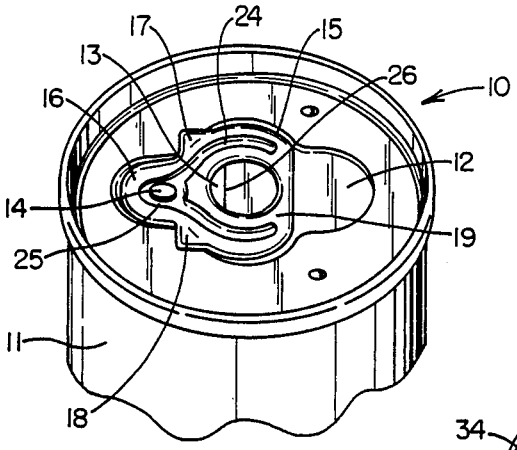
FIG. 1 is a fragmentary perspective view of an upper portion of a can having a can top opening assembly according to the present invention in its normally closed position.

As indicated in the drawings, a can top, generally designated 10, is adapted for use on a can body 11 of conventional size and construction for containing beverages or other liquids. Preferably, both the can top 10 and can body 11 are formed from relatively thin gauge steel. It is also advantageous to stamp or press a generally oblong depression 12 into the upper surface of the can top in which a portion of the present opening assembly may be seated while it is in a normally closed position.

The present opening assembly basically comprises a tongue 13 integrally formed in the can top and provided with a tab-engaging component, such as a rivet-like protrusion or teat 14, and a pull tab 15. The pull tab 15 is provided with a tongue-engaging component 16 normally disposed in overlying relation to the tongue, at least one pivot component 17 or 18 projecting from the pull tab in overlying relation to at least one point on the can top adjacent to the tongue, and a lever component 19 which is manually movable in a first direction 20 (FIG. 2) to displace a first portion 21 of the tongue under a second portion 22 thereof, and in a second direction 23 (FIG. 3) to displace the tongue outwardly relative to the can top.

The present invention also encompasses a method of forming a can top opening assembly which basically comprises forming the tongue 13 on the can top 10, providing the tongue with a tab-engaging component 14, providing the pull tab 15 with a tongue-engaging component 16, a pivot component 17 or 18 and a lever component 19, and securing the pull tab 15 to the tongue 13. Further, the pull tab 15 is secured to the tongue 13 in such a manner that the tongue-engaging component 16 is normally disposed in overlying relation to the tongue, at least one pivot component 17 or 18 projects from the tab in overlying relation to at least one point on the can top adjacent to the tongue, and the lever component 19 is manually movable in the first direction 20 to displace the first portion 21 of the tongue under the second portion 22 thereof, and is manually movable in the second direction 23 to displace the tongue outwardly relative to the can top 10.

Preferably, the pull tab 15 is generally ring-shaped and is stamped from a sheet of aluminum or steel in a manner well known in the art. The outer edges of the pull tab are folded under so that the operator is not cut or scratched when the tab is grasped. In addition, a wishbone-shaped impression 24 may be formed advantageously in the pull tab for reinforcement. The tongue-engaging component 16 of the tab may be defined by a central rivet-receiving aperture and by a generally arcuately shaped nose portion disposed in partially surrounding relation to the aperture. The pivot component of the pull tab preferably comprises a pair of relatively spaced apart shoulders 17 and 18 projecting laterally in opposite directions from the tab intermediately of the tongue-engaging portion 16 and the lever component 19. It is advantageous to stamp or press the pull tab so that the shoulders are slightly raised relative to the general plane of the tab. In this manner, the shoulders 17, 18 are disposed in overlying relation to relatively raised portions of the can top adjacent to the depression 12 (FIG. 1). The lever component 19 preferably includes a finger-sized opening and encompasses the bulk of the pull tab. Like the outer edges of the pull tab, the inner edges which define the finger-receiving opening are turned under to avoid injury and discomfort to the operator.

Figure 5:
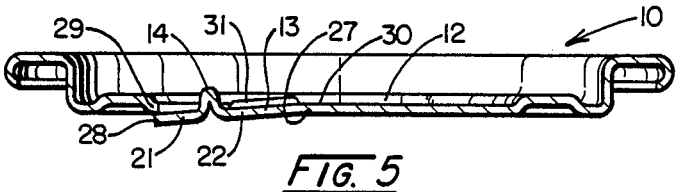
FIG. 5 is a medial, vertical cross-sectional view of the present can top opening assembly and particularly illustrates a preferred manner of forming the integral tongue and providing said tongue with a tab-engaging component.
Figure 6:
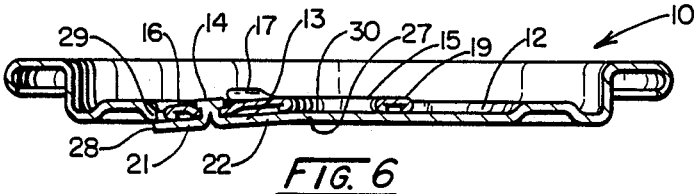
FIG. 6 is a medial, vertical cross-sectional view similar to FIG. 5 and particularly illustrates a preferred manner of securing a tab to the integral tongue.

When the can top 10 is formed from steel, it is preferable to lance the tongue from the can top except along one transverse end 26 of the second portion 22 of the tongue adjacent to the can top and to score the material on the undersurface of this end 26 with a transverse bend line 27 (FIGS. 5, 6). By providing the bend line 27, movement of the ring or leverage portion 19 of the tab in the second direction 23 to displace the tongue outwardly from the can top is faciliated, without causing the tongue to separate completely from said can top. Preferably, the bend line is interrupted at the center of the tongue end 26. In this manner, the tab 15 and tongue 13 assembly are less likely to separate from the can top if the tab is twisted or moved back and forth by the user after the can has been opened.

Preferably, movement of the tab in the first direction 20 (FIG. 2) is generally arcuate, is centered at the points of engagement of the shoulders 17, 18 with the can top, and causes the first portion 21 of the tongue to bend under the second portion 22. Movement of the lever means in the second direction 23 (FIG. 3) is also preferably arcuate and opposite to the first direction, is centered at the transverse bend line 27 of the second portion 22 of the tongue, and causes the tongue to bend outwardly relative to the can top. By bending the tongue 13 transversely between first and second portions 21 and 22, said tongue is made sufficiently compact for the tab 15 to remain within the area of the can top 10, even with the tongue in the fully opened position shown in FIG. 3.

Figure 7:
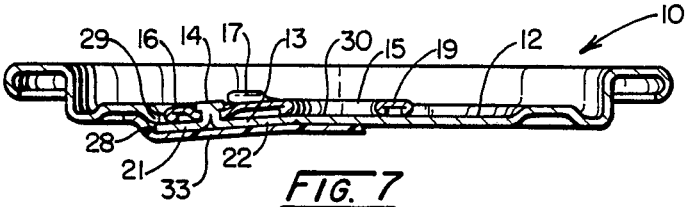
FIG. 7 is a medial, vertical cross-sectional view similar to FIGS. 5 and 6 and particularly illustrates a preferred manner of applying a film of synthetic resin material to the underside of the can top in covering relation to the tongue.

As best indicated in FIGS. 5 through 7, if the can top 10 is made from steel, it is preferable for a leading edge 28 of the first portion 21 of the tongue to be normally disposed in underlying relation to an adjacent area 29 of the can top. This underlying relationship may be accomplished in the manner set forth in U.S. Pat. No. 4,624,386 by stretching and slightly thinning the can top in the area 30 immediately behind the end of the tongue defined by the bend line 27. It is also preferable in steel applications to provide the second portion 22 of the tongue with a reinforcing rib 31, 32 (FIGS. 2, 5) along each edge adjacent to the can top. In this manner, the bending of the unreinforced first portion 21 of the tongue is faciliated.

As indicated in FIG. 7, a film of rupturable synthetic resin material 33 may be adhesively secured to an underside of the can top in covering relation to the tongue. In this manner, the beverage and carbon dioxide, if present, are prevented from escaping through the gaps created between the sides of the tongue and the can top when the tongue is cut or lanced therefrom.

Alternatively, the tongue 13 could be integrally formed on the can top 10 by means of a score line provided on the upper surface thereof, rather than by lancing completely through the metal. In the usual manner, such a score line would thin and thus weaken the metal defining the outline of the tongue except for the end 26, which would still be provided with an interrupted bend line 27 on the undersurface thereof. Since the proposed score line would not cut completely through the metal, the leading edge 28 on the tongue would be substantially coplanar with, rather than in underlying relation with, the adjacent area 29 of the can top. In addition, it would not be necessary to provide a layer of film 33 on the undersurface since there would be no space between the tongue and the can top through which liquid or gas could pass unless and until the can top were opened. It is believed that the leverage provided by fashioning the tab shoulders 17, 18 for pivotal contact with the can top on opposite sides of the tongue 13 would be sufficient to break the relatively thin material below the score line first at the leading edge 28 of the tongue and hence along both sides thereof as the tab is lifted in the first direction 20.

Figure 2:
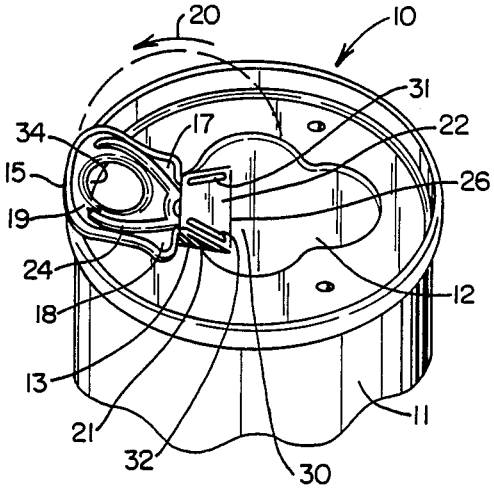
FIG. 2 is a fragmentary perspective view similar to FIG. 1 in which the present opening assembly is in an intermediate opened position.
Figure 3:
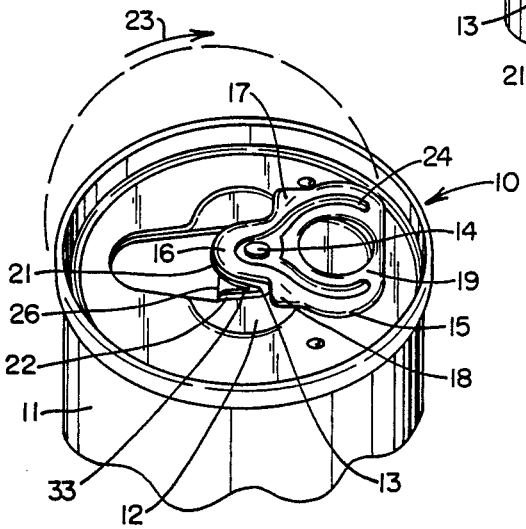
FIG. 3 is a fragmentary perspective view similar to FIGS. 1 and 2 in which the present opening assembly is in a fully opened position.
Figure 4:
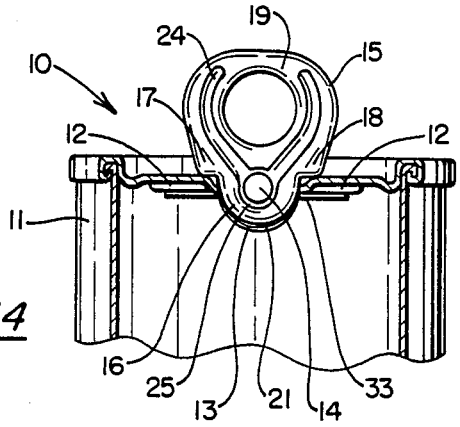
FIG. 4 is a fragmentary side elevational view wherein an upper portion of the can is cut away and particularly illustrates the pivotal action of the pull tab during an intermediate stage of the opening process.

FIGS. 1 and 7 illustrate the present can top opening assembly in its normally closed condition, wherein the tongue is substantially flat and is disposed in closely underlying relation to the can top, and the synthetic resin film 33 seals the gaps between the tongue and surrounding edges of the can top. In this closed condition, the pull tab 15 lies in the depression 12 in generally flat, parallel relation to the outer or upper surface of the can top. When it is desired to open the can, the lever or ring component 19 is manually grasped by the operator, lifted from the upper surface of the can top and urged in the direction 20 of the tongue-engaging nose 16 of the tab. Movement of the tab in this direction 20 is facilitated by the pivotal action of the shoulders 17, 18 against the can top, thereby driving the first portion 21 of the tongue downwardly and rupturing the film 33 (FIG. 4). It may be noted, however, that the first portion 21 descends into the can a relatively short distance and is unlikely to contact the contents. The operator continues to push the ring portion 19 of the tab in the first direction 20 until contact is made with a rim portion 34 (FIG. 2) of the can top adjacent to where the first portion of the tongue normally lies. At this point, the first portion 21 is substantially completely bent under the second portion 22, and said second portion 22 has elevated slightly due to the pivotal action of the shoulders 17, 18 against the can top (FIG. 2). The operator then pulls or pushes the ring portion of the tab in the opposite direction 23 until it rests upon the can top, thereby bending the tongue along the transverse bend line 27, and lifting the first portion 21 entirely out of the can. Since the first portion 21 is folded under the second portion 22, no contact is made with the edges of the can top surrounding the tongue 13. In this manner, the entire tongue 13 and an associated portion of the film 33 are disposed outwardly, but remain connected to, the can top, and the contents of the can may be removed.

While a single, preferred embodiment of the invention has been illustrated and described in some detail, it will be understood that various modifications in design and details of construction may be made without departing from the spirit of the invention or the scope of the following claims.

I claim:

1. A can top opening assembly comprising:

(a) a unitary tongue integrally formed in the can top, said tongue being bendable at an intermediate area thereof into first and second portions and at an end of the second portion attached to the can top;

(b) a pull tab provided with:

(1) a nose section disposed in overlying relation to and generally coextensive with the first portion of the tongue;

(2) lever means manually movable in a first direction to bend the first portion of the tongue under the second portion thereof and in a second direction to bend said tongue at the end of the second portion over the can top; and (3) pivot means disposed intermediately of the nose section and lever means in overlying relation to at least one point on the can top adjacent to the intermediate area of the tongue; and (c) fastening means for securing the nose section of the pull tab to the first portion of the tongue.

2. A can top opening assembly according to claim 1, wherein the pivot means on the pull tab pivotally engages at least one generally fixed point on the can top as the lever means is manually moved in the first direction.

3. A can top opening assembly according to claim 1, wherein the lever means is disposed inwardly of an outer edge portion of the can top upon completion of movement of said lever means in the second direction.

4. A can top opening assembly according to claim 1, wherein the fastening means comprises a rivet-like projection formed on the tongue and provided with a stem extending through a opening in the nose portion of the pull tab and with an enlarged head at a free end of the stem.

5. A can top opening assembly according to claim 1, wherein the pivot means comprises a pair of relatively spaced apart, laterally projecting shoulders disposed on opposite sides of the pull tab.

6. A can top opening assembly according to claim 1, wherein a free edge of the first portion of the tongue is normally disposed in underlying relation to an adjacent area of the can top.

7. A can top opening assembly according to claim 1, wherein a film of rupturable synthetic resin material is applied to an underside of the can top in covering relation to the tongue.

8. A can top opening assembly according to claim 1, wherein the second portion of the tongue is provided with at least one rib.

9. A can top opening assembly according to claim 1, wherein the can top and the tongue are formed from steel.

10. A can top opening assembly according to claim 1, wherein the end of the second portion of the tongue attached to the can top is defined by an interrupted transverse bend line.

11. A can top opening assembly according to claim 1, wherein the tongue is lanced from the can top except along the end of the second portion of said tongue attached to said can top.

12. A can top opening assembly according to claim 1, wherein the tongue is normally defined by a score line formed in the can top with the exception of the end of the second portion of said tongue attached to said can top.

13. A method of forming a can top opening assembly which comprises:

(a) integrally forming a tongue on the can top, said tongue being bendable at an intermediate area thereof into first and second portions and at an end of the second portion attached to the can top;

(b) forming a pull tab with manually operable lever means and a nose section which is generally coextensive with the first portion of the tongue and with pivot means disposed intermediately of said lever means and nose section;

(c) positioning the pull tab on the can top so that the nose section is disposed in overlying relation to the first portion of the tongue, and so that the pivot means is disposed in overlying relation to at least one point on the can top adjacent to the intermediate area of the tongue; and (d) securing the nose section of the pull tab to the first section of the tongue so that the lever means is movable in a first direction to bend the first portion of the tongue under the second portion thereof and is movable in a second direction to bend said tongue over the can top.

14. A method of forming a can top opening assembly according to claim 13, which includes applying a film of rupturable synthetic resin material to an underside of the can top in covering relation to the tongue.

* * * * *